US007767918B2

(12) United States Patent
Hofmann et al.

(10) Patent No.: US 7,767,918 B2
(45) Date of Patent: Aug. 3, 2010

(54) POWER TOOL

(75) Inventors: Albrecht Hofmann, Steinbronn (DE); Harald Krondorfer, Mundelein, IL (US); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 993 days.

(21) Appl. No.: 10/583,238

(22) PCT Filed: Nov. 8, 2004

(86) PCT No.: PCT/EP2004/052873

§ 371 (c)(1),
(2), (4) Date: Jun. 16, 2006

(87) PCT Pub. No.: WO2005/062322

PCT Pub. Date: Jul. 7, 2005

(65) Prior Publication Data

US 2007/0102268 A1 May 10, 2007

(30) Foreign Application Priority Data

Dec. 20, 2003 (DE) ..... 103 60 249

(51) Int. Cl.
*H01R 13/70* (2006.01)

(52) U.S. Cl. ..... 200/50.01; 200/50.15

(58) Field of Classification Search ..... 200/50.06, 200/50.15, 50.02
See application file for complete search history.

(56) References Cited

U.S. PATENT DOCUMENTS

| | | | | |
|---|---|---|---|---|
| 3,952,239 | A * | 4/1976 | Owings et al. | 320/113 |
| 4,335,514 | A | 6/1982 | Overy et al. | |
| 5,289,047 | A | 2/1994 | Broghammer | |
| 5,401,928 | A | 3/1995 | Kelley | |
| 6,551,123 | B1 | 4/2003 | Schaeffeler et al. | |

* cited by examiner

*Primary Examiner*—Renee S Luebke
*Assistant Examiner*—Lisa Klaus
(74) *Attorney, Agent, or Firm*—Michael J. Striker

(57) ABSTRACT

A power tool has a power supply unit that can be removed on a device side for supplying electrical power, at least one indirectly actuatable switch for switching a drive machine on and off, a decoupling device for decoupling the switch, and a switching unit that actuates the switch at least indirectly.

9 Claims, 2 Drawing Sheets

POWER TOOL

CROSS-REFERENCE TO RELATED APPLICATION

The invention described and claimed hereinbelow is also described in German Patent Application DE 10 360249.6 filed on Dec. 20, 2003. This German Patent Application, whose subject matter is incorporated here by reference, provides the basis for a claim of priority of invention under 35 U.S.C. 119(a)-(d).

BACKGROUND OF THE INVENTION

The present invention relates to a power tool.

Battery-operated power tools typically have a plug-in end for a rechargeable-battery block that contains electrical contacts and a locking system with mechanical lock-in. An electric switch actuated using a switching means is used to turn the power tool on and off. So that the switching means need not be permanently actuated during use, it can be locked in the "on" position, in which the switch is turned on. When the locking device is released, the switch automatically snaps back into the "off" position, in which the switch is turned off. When the rechargeable-battery block is replaced, it is possible for the switching means to accidentally remain locked in the "on" position and for the power tool to unintentionally start up when the charged rechargeable-battery block is attached.

SUMMARY OF THE INVENTION

The present invention is directed to a power tool with a removable power supply unit on the device side for supplying electrical power, with at least one indirectly operable switch for switching a drive machine on and off.

It is provided that a decoupling device for decoupling the switch and a switching means that actuates the switch at least indirectly are provided. The decoupling device, in particular, is configured and/or designed accordingly. Switches and switching means can be set or actuated independently of each other.

The decoupling device is preferably provided to forcibly turn off the switch when the power supply unit is removed and the switching means are locked in an "on" position, in which the switch can be switched on during normal operation. The decoupling device preferably includes at least one spring element. If the switching means are operatively connected with the spring element that causes the switch to turn on when the power supply unit is removed and the switching means are in the "on" position, simple and reliable handling is made possible. The normal operating state can be restored via a forcible release of the switching means from the "on" position. The power tool can be effectively prevented from accidentally starting up when the power supply unit is connected. The power supply unit is preferably a rechargeable-battery block or a battery block. The operational reliability of a power tool with a lockable switching means is increased. The present invention is particularly suited for power tools with which the switching means is lockable in the "on" position during operation.

An additional level of protection is achieved when at least one blocking means for blocking a coupling of the power supply unit when the switching means are in the "on" position and the switch is turned off. Maloperation is reliably prevented. The power supply unit cannot supply the switch with electric power as long as the blocking means are in the blocked position. The operator must first move the switching means into an "off" position before the power supply unit can be completely reinserted in the power tool and the switch can be turned on with the switching means.

If an actuating device is located between the switching means and the switch that includes at least a portion of the decoupling device, it can actuate the switch on a case-by-case basis or block attachment of the power supply unit without requiring any additional components. The system has a compact design and can be reliably operated. It is particularly advantageous when the actuating device includes at least one blocking means. Particularly safe handling is made possible.

If the power supply unit has a neck projecting at an angle that is operatively connected with the actuating device, it can be ensured—when the power supply unit is removed—that the actuating device can be disengaged from the switch.

If the actuating device according to a first and third exemplary embodiment has a multi-position flexible coupling, the spring element serving to rotate a first leg of the actuating device relative to a second leg that actuates the switch, the actuating device can be disengaged from the switch via rotation of the second leg. The actuating device can be detached from a pushbutton of the switch by rotating it while, when rotated in the reverse direction, the second leg impacts the pushbutton and is unable to engage with it until the switching element is moved into the "off" position and, to turn it on in normal operation, back to the "on" position. As an alternative, the actuating device is connected with a tension spring that disengages the actuating device and keeps it disengaged until the switching means are moved into the "off" position. To turn on the power tool, the switching means are moved back into the "on" position.

If the neck has a projection that is operatively connected with the actuating device, rotation of the actuating device can be easily enabled when the power supply unit is removed by the fact that, e.g., the projection slides over a lever and displaces it.

If, according to a second exemplary embodiment, the actuating device has a recess, the spring element being provided to disengage the recess from a switch lever of the switch, it can interact with a switch lever of the switch and turn the switch on and off. The actuating device blocks attachment of the power supply unit until the switching means are turned off and then back on again.

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DESCRIPTION OF THE PREFERRED EMBODIMENTS

Figure 1:
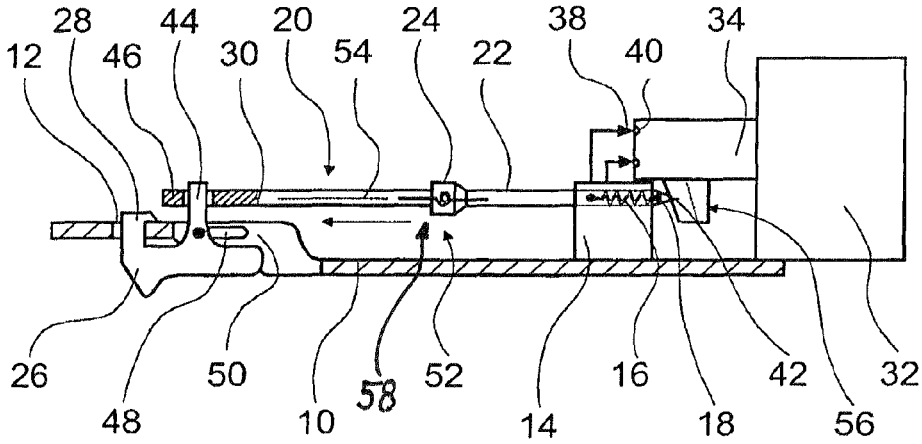
FIG. 1 Shows a section of a system according to the present invention according to a first exemplary embodiment with an actuating device with a multi-purpose flexible coupling, FIG. 2 Shows a section of a system according to the present invention according to a second exemplary embodiment with an actuating device with a tension spring, FIG. 3 Shows a section of a system according to the present invention according to a third exemplary embodiment with an actuating device with a multi-purpose flexible coupling and an angled end piece.

FIG. 1 is a schematic illustration of a section of a power tool according to a first exemplary embodiment of the present invention. A power supply unit 32 designed as a rechargeable-battery block that is removable from the device side and is located in housing 10 serves to supply electric power to a not-shown electrical drive machine. Power supply unit 32 designed as a rechargeable-battery block has a neck 34 pointing toward a switch 14 and projecting at an angle, with electrical contact means 40, e.g., sockets. Switch 14 is connected with corresponding electrical contact means 38, e.g., plugs, which can be inserted in the sockets.

When power supply unit 32 is inserted, the drive machine is turned on and off using switch 14 in that an actuating device 20 designed as an adjusting slide presses against a pushbutton 18 of switch 14. When pushbutton 18 is released, a compression spring 16 presses pushbutton 18 outward and automatically turns switch 14 off.

Actuating device 20 designed as an adjusting slide has a two-component configuration and includes a first leg 30 and a second leg 22. First leg 30 is connected with second leg 22 via a multi-purpose flexible coupling 52 that has a spring element 24 configured as a compression spring. Multi-purpose flexible coupling 52 allows second leg 22 to rotate relative to first leg 30 around a longitudinal axis 54. Multi-purpose flexible coupling 52 and spring element 24 form a decoupling device 58 with which a switching means 26 and switch 14 can be decoupled, so that switch 14 can be turned off, even though switching means 26 is locked in the "on" position. After a rotation action, spring element 24 designed as a torsion spring causes second leg 22 to return to its home position. The lower region of second leg 22 that latches behind pushbutton 18 has a surface 42 that is three-dimensionally inclined at an angle, by way of which second leg 22 rotates relative to first leg 30 as soon as a force acts in the switch-on direction indicated by an arrow and second leg 22 therefore does not bear against a corresponding surface of neck 34 of power supply unit 32.

When power supply unit 32 is inserted, second leg 22 bears against neck 34 of power supply unit 32, which blocks second leg 22 from rotating relative to first leg 30. Actuating device 20 configured as an adjusting slide can be slid forward in the direction of the arrow using switching means 26 designed as a pushbutton. Via a driving feature 44 that engages in a recess 46 of actuating device 20, actuating device 20 is driven and switch 14 is turned on via pushbutton 18. To allow displacement, switching means 26 are guided in a recess 48 of a guide element 50. Switching means 26 designed as a pushbutton can be locked in the "on" position by engaging a locking projection 28 in a corresponding recess 12 in the housing.

When power supply unit 32 is removed, second leg 22 of actuating device 20 pivots to the side due to the spring force of spring element 24 designed as a torsion spring and surface 42 at the end of second leg 22, the surface being three-dimensionally inclined at an angle (upward in the figure). As a result, switch 14 turns off automatically by the fact that compression spring 16 presses pushbutton 18 outwardly.

Reattachment of power supply unit 32 is prevented by pivoted-away second leg 22 of actuating device 20 designed as an adjusting slide, surface 42 that is three-dimensionally inclined at an angle forming a blocking means 56 that prevents switch 14 from being energized and also blocks power supply unit 32 from being inserted. Power supply unit 32 cannot be reinserted and attached until switching means 26 has been moved from the "on" position into the "off" position.

To bring second leg 22 back into its home position and enable complete attachment of power supply unit 32, switching means 26 designed as a pushbutton must be moved manually into the "off" position. With switching means 26 designed as a pushbutton in the "off" position, second leg 22 returns to its home position due to the spring force of spring element 24 designed as a torsion spring, and latches behind pushbutton 18 of switch 14. In this position, power supply unit 32 can be inserted. When switched on, actuating device 20 designed as an adjusting slide bears against neck 34 of power supply unit 32.

Figure 2:
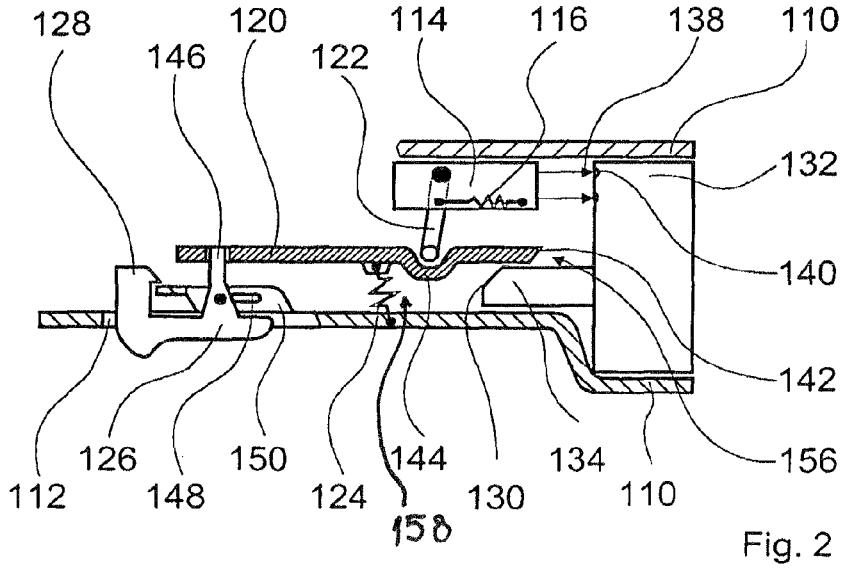

FIG. 2 is a schematic illustration of a section of a power tool according to a second exemplary embodiment of the present invention. A power supply unit 132 designed as a rechargeable-battery block that is removable from the device side and is located in housing 110 serves to supply electric power to a not-shown electrical drive machine. Power supply unit 132 designed as a rechargeable-battery block has a neck 134 that points toward a switch 114, the neck having an angled surface 130 on its end face pointing toward switch 114. Electrical contact means 140, e.g., sockets, are located on power supply unit 132 configured as a rechargeable-battery block. Switch 114 is connected with corresponding electrical contact means 138, e.g., plugs, which can be inserted in the sockets.

When power supply unit 132 is plugged in, the drive machine is turned on and off via switch 114 by the fact that an actuating device 120 designed as an adjusting slide—which is displaceable via an indentation 144 of a switching means 126 designed as a pushbutton—acts on a switch lever 118 of switch 114. To displace switching means 126 designed as a pushbutton, it is guided in a recess 148 of a guide element 150 substantially parallel to housing 110. A compression spring 116 automatically presses switch lever 118 into an "on" position (toward the right in the figure) as soon as switch lever 118 is not pressed into the "on" position (toward the left in the figure). During operation, switch 114 can be held in the "on" position by the fact that a locking projection 128 of switching means 126 designed as pushbutton latches in a recess 112 in housing 110. Actuating device 120 designed as an adjusting slide has an indentation 144 into which a switch lever 122 engages. Actuating device 120 designed as an adjusting slide is connected with housing 110 in the vicinity of indentation 144 via a spring element 124 designed as a tension spring. Indentation 144 and spring element 124 form a decoupling device 158 with which switching means 126 and switch 114 can be decoupled, so that switch 114 can be turned off, even though switching means 126 are locked in the "on" position.

When power supply unit 132 is plugged in, actuating device 120 designed as an adjusting slide bears against neck 134 of power supply unit 132, actuating device 120 designed as an adjusting slide resting against neck 134 so that actuating device 120 designed as an adjusting slide is oriented substantially parallel to housing 110. As a result, switch lever 118 is moved into the "on" position. Switching means 126 designed as pushbutton can be locked in recess 112 by latching locking projection 128. When the locking mechanism is released, compression spring 116 moves switch lever 118 into the "off" position, while the switch lever simultaneously pulls actuating device 120 designed as an adjusting slide and switching means 126 designed as a pushbutton into the "off" position (toward the right in the figure).

When power supply unit 132 is removed, spring element 124 designed as a tension spring pulls actuating device 120 designed as an adjusting slide downward in the direction of housing 110, switch lever 118 disengaging and being tilted into the "off" position by compression spring 116. Switching means 126 designed as pushbutton remain in the "on" position, however. Power supply unit 132 cannot be attached now, since its plug-in end is blocked by actuating device 120 designed as an adjusting slide. The end piece of actuating device 120 with an angled surface 142 forms a blocking means 156 that prevents switch 114 from being energized and also blocks insertion of power supply unit 132 provided actuating device 120 does not bear against neck 134. Power supply unit 132 cannot be reinserted and attached until switching means 126 has been moved from the "on" position into the "off" position.

To attach power supply unit 132, it is therefore necessary to insert switching means 126 designed originally as a pushbutton into a guide element 150 in the "off" position (toward the right in the figure), actuating device 120 being slid along with it via a driving feature 146. Indentation 144 in actuating device 120 designed as an adjusting slide, and switch lever 118 become covered. If power supply unit 132 is now inserted, actuating device 120 designed as an adjusting slide is slid via corresponding inclined surfaces 130, 142 on neck 134 and on the end piece of actuating device 120 designed as an adjusting slide against the spring force of spring element 124 configured as a tension spring in the direction of switch 114. Switch lever 118 engages in indentation 144. Switch 114 can now be turned on with switching means 126 designed as a pushbutton.

Figure 3:
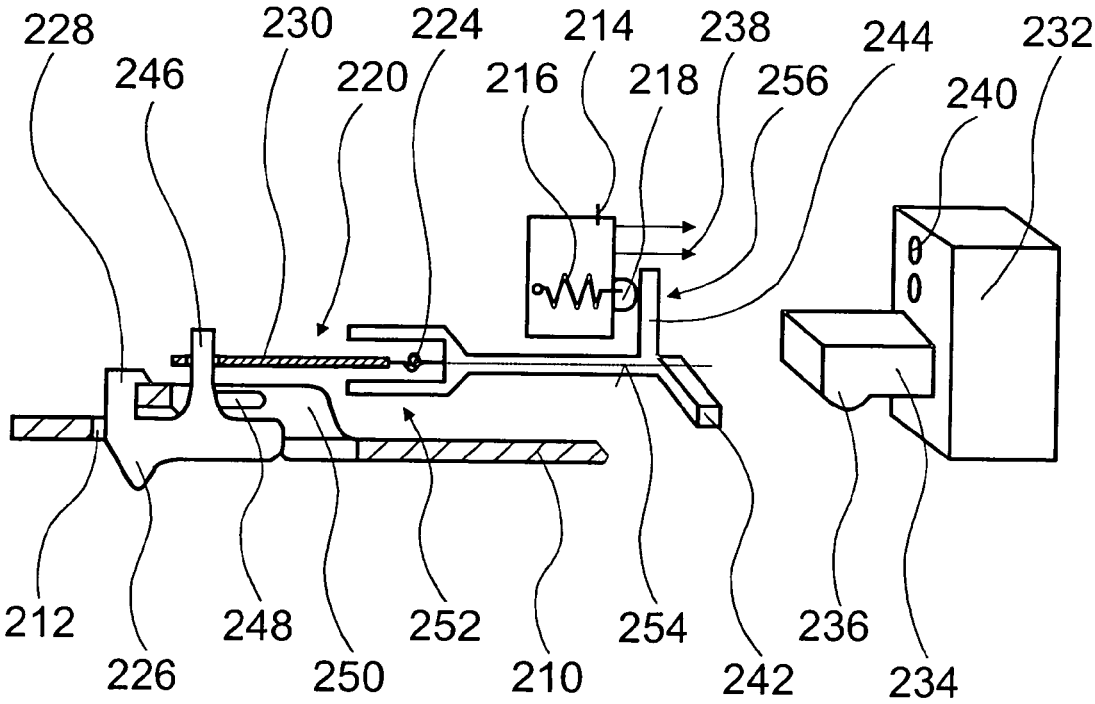

FIG. 3 is a schematic illustration of a section of a power tool according to a third exemplary embodiment of the present invention. A power supply unit 232 designed as a rechargeable-battery block that is removable from the device side and is located in housing 210 serves to supply electric power to a not-shown electrical drive machine. Power supply unit 232 designed as a rechargeable-battery block has a neck 234 pointing toward a switch 214 and projecting at an angle, with a projection 236 pointing downward toward housing 210. Furthermore, electrical contact means 240, e.g., sockets, are provided. Switch 214 is connected with corresponding electrical contact means 238, e.g., plugs, which can be inserted in the sockets.

When power supply unit 232 is inserted, the drive machine is turned on and off using switch 214 by the fact that an actuating device 220 designed as an adjusting slide presses against a pushbutton 218 of switch 214. When pushbutton 218 is released, a compression spring 216 presses pushbutton 218 outward and automatically turns switch 214 off.

Actuating device 220 designed as an adjusting slide has a two-component configuration and includes a first leg 230 and a second leg 222. First leg 230 is connected with second leg 222 via a multi-purpose flexible coupling 252 that has a spring element 224 configured as a compression spring. Multi-purpose flexible coupling 252 encloses, in the manner of a fork, spring element 224 designed as a torsion spring and allows second leg 222 to rotate relative to first leg 230 around a longitudinal axis 254. Multi-purpose flexible coupling 252 and spring element 224 form a decoupling device 258 with which a switching means 226 and switch 214 can be decoupled, so that switch 214 can be turned off, even though switching means 226 is locked in the "on" position. Second leg 222 has two fingers 242, 244 arranged perpendicularly to each other and to longitudinal axis 254, second finger 244 of which acts on pushbutton 218 and the other finger 242 interacting with projection 236 of power supply unit 232.

Spring element 224 designed as a torsion spring retains second leg 222 of actuating device 220 designed as an adjusting slide in its home position in which it latches behind pushbutton 218 of switch 214. In this position, switch 214 can be moved by switching means 226 configured as a pushbutton into the "on" position (toward the left in the figure), and it is locked in place via the latching of a locking projection 228 in recess 212. When power supply unit 232 is inserted, first finger 242 in the figure is located below neck 234 between projection 236 and power supply unit 232.

When power supply unit 232 is removed, projection 236 causes switch 214 to turn off immediately by the fact that second leg 222 of actuating device 220 designed as an adjusting slide rotates and is disengaged from pushbutton 218. The spring force of compression spring 216 causes switch 214 to turn off.

When power supply unit 232 is inserted, projection 236 on neck 234 of power supply unit 232 displaces first finger 242 of second leg 222 of actuating device 220 designed as an adjusting slide and disengages pushbutton 218 from second finger 244 of second leg 222. Second finger 244 forms a blocking means 256 that prevents switch 214 from being turned on and energized, since actuating device 220 must first be moved from the "on" position and into the "off" position before switch 214 can be re-actuated.

When power supply unit 232 is connected, first finger 242 is deflected against the spring force of spring element 224 as soon as projection 236 moves over finger 242. As a result, actuating device 220 configured as an adjusting slide, and/or its second finger 244, and pushbutton 218 disengage briefly, and pushbutton 218 jumps into the "off" position due to the spring force of compression spring 216 before contact means 240 of power supply unit 232 can come in contact with corresponding, device-side contact means 238. When power supply unit 232 is inserted completely, projection 236 is no longer in contact with first finger 242. Spring element 224 configured as a torsion spring brings about a return motion of second leg 222 and/or second finger 244 that is not complete, since second finger 244 now comes to rest against pushbutton 218 located in the "off" position and cannot latch behind it.

To turn on, switching means 226 configured as a pushbutton must first be moved into the "off" position. To this end, switching means 226 are slid in a recess 248 of a guide element 250, actuating device 220 being displaced by a driving feature 246. The spring force of spring element 224 designed as a torsion spring causes actuating device 220 designed as an adjusting slide to swivel completely back to its home position. In its home position, actuating device 220 designed as an adjusting slide latches behind pushbutton 218, and the power tool can be turned on.

What is claimed is:

1. A power tool with a power supply unit that can be removed on a device side for supplying electrical power, with at least one indirectly actuatable switch for switching a drive machine on and off, wherein a decoupling device for decoupling the switch and a switching means that actuates the switch at least indirectly are provided, and wherein the decoupling device is provided for forcibly turning off the switch when the power supply unit is removed and then the switch is locked in an "on" position in which the switch can be switched on during normal operation.

2. A power tool with a power supply unit that can be removed on a device side for supplying electrical power, with at least one indirectly actuatable switch for switch in a drive machine on and off wherein a decoupling device for decoupling the switch and a switching means that actuates the switch at least indirectly are provided, and wherein at least one blocking means is provided for blocking attachment of the power supply unit when the switching means are in the "on" position and the switch is turned off.

3. The power tool as recited in claim 1, wherein the decoupling device includes a spring element.

4. A power tool with a power supply unit that can be removed on a device side for supplying electrical power, with at least one indirectly actuatable switch for switching a drive machine on and off, wherein a decoupling device for decouplinq the switch and a switching means that actuates the switch at least indirectly are provided, and wherein an actuating device is located between the switching means and the switch, which includes at least a portion of the decoupling device.

5. The power tool as recited in claim 4, wherein the power supply unit has a neck that projects at an angle and is operatively connected with the actuating device.

6. The power tool as recited in claim 5, wherein the neck has a projection that is operatively connected with the actuating device.

7. The power tool as recited in claim 4, wherein the actuating device includes the at least one blocking means.

8. The power tool as recited in claim 4, wherein the actuating device has a multi-position flexible coupling, a spring element being provided for rotating a first leg of the actuating device relative to a second leg that actuates the switch.

9. The power tool as recited in claim 4, further comprising a spring element associated with the actuating device, and wherein the actuating device has an indentation, the spring element being provided to disengage the indentation from a switch lever of the switch.

* * * * *